US006883524B2

(12) United States Patent
Ishikawa et al.

(10) Patent No.: US 6,883,524 B2
(45) Date of Patent: Apr. 26, 2005

(54) WRAPPER PAPER FOR SMOKING ARTICLES

(75) Inventors: Satoshi Ishikawa, Tokyo (JP); Takeo Tsutsumi, Yokohama (JP); Makoto Sato, Fuji (JP); Kaoru Inoue, Fuji (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/705,942

(22) Filed: Nov. 13, 2003

(65) Prior Publication Data

US 2004/0094173 A1 May 20, 2004

Related U.S. Application Data

(63) Continuation of application No. PCT/JP02/04649, filed on May 14, 2002.

(30) Foreign Application Priority Data

May 16, 2001 (JP) ..... 2001-146538

(51) Int. Cl.[7] ..... A24D 1/02
(52) U.S. Cl. ..... 131/365; 131/349; 162/139
(58) Field of Search ..... 131/365, 349; 162/139

(56) References Cited

U.S. PATENT DOCUMENTS

| | | | | |
|---|---|---|---|---|
| 4,964,427 | A * | 10/1990 | Case et al. | 131/365 |
| 2003/0070688 | A1 * | 4/2003 | Aoki et al. | 131/364 |

FOREIGN PATENT DOCUMENTS

| | | | |
|---|---|---|---|
| EP | 0 791 688 | A1 | 8/1997 |
| JP | 63-37621 | B2 | 7/1988 |
| JP | 2730894 | B2 | 12/1997 |
| JP | 10-81 | A | 1/1998 |
| JP | 2000-287667 | A | 10/2000 |
| TW | 149426 | | 1/1991 |

OTHER PUBLICATIONS

Taiwan Office Action with English translation dated May 16, 2001, which issued in copending Taiwanese Application No. 091110086.

* cited by examiner

*Primary Examiner*—Dionne A. Walls
(74) *Attorney, Agent, or Firm*—Birch, Stewart, Kolasch & Birch LLP

(57) ABSTRACT

Wrapper paper for a smoking article carries 1 g/m$^2$ to 15 g/m$^2$ of a burn adjusting agent and 1 g/m$^2$ to 30 g/m$^2$ of a calcium phosphate-based compound in the wrapper paper.

4 Claims, No Drawings

WRAPPER PAPER FOR SMOKING ARTICLES

CROSS-REFERENCE TO RELATED APPLICATIONS

This is a Continuation Application of PCT Application No. PCT/JP02/04649, filed May 14, 2002, which was not published under PCT Article 21(2) in English.

This application is based upon and claims the benefit of priority from the prior Japanese Patent Application No. 2001-146538, filed May 16, 2001, the entire contents of which are incorporated herein by reference.

BACKGROUND OF THE INVENTION

1. Field of the Invention

The present invention relates to a wrapper paper for a smoking article such as a cigarette, and more particularly to a smoking article wrapper paper that can reduce sidestream smoke.

2. Description of the Related Art

When smoking a smoking article such as a cigarette, tobacco generates main-stream smoke to be inhaled by the smoker through the tobacco body and sidestream smoke that rises from the distal end portion of the lit smoking article especially while it is in static burn.

The measurement of the sidestream smoke is carried out by the fishtail method disclosed in Jpn. Pat. Appln. KOKAI Publication No. 10-81. Conventionally, there have been a great number of proposals made to provide smoking articles that generate a less amount of sidestream smoke. An example is to add a compound that exhibits a combustion suppressing effect as a filler to wrapper paper of the smoking article. More specifically, Jpn. Pat. Appln. KOKOKU Publication No. 63-37621 discloses the addition of magnesium hydroxide gel, and Japanese Patent No. 2730894 discloses the addition of a filler having a high specific surface, consisting of, for example, calcium carbonate.

However, the conventional wrapper paper designed to reduce the sidestream smoke of tobacco entails drawbacks such as an expensive additive and unstable quality depending on the production method, and any of them have not yet been put to a practical use of a satisfactory level. Therefore, there is a great demand for measures to reduce the sidestream smoke of tobacco more easily and more effectively.

Under the circumstances, an object of the present invention is to provide wrapper paper for a smoking article, which can reduce the sidestream smoke of tobacco more easily and more effectively than the conventional wrapper paper.

BRIEF SUMMARY OF THE INVENTION

The inventors of the present invention have carried out intensive studies to achieve the above-described object, and confirmed that a calcium phosphate-based compound such as tricalcium phosphate exhibits a tendency of slightly promoting the static burn rate of wrapper paper, but it does not show a tendency of significantly reducing the amount of sidestream smoke if the content of a burn adjusting agent is equal to or less than the amount usually contained in ordinary wrapper paper when the agent is used. However, the inventors further have found out that when a predetermined amount of a calcium phosphate-based compound is used in combination with a predetermined amount of an organic acid salt burn adjusting agent such as sodium citrate, a significant and unexpected sidestream smoke reducing effect that cannot be achieved with the prior art methods is obtained. Based on this finding, the present invention has been achieved.

Thus, the present invention provides wrapper paper for a smoking article, which carries 1 g/m$^2$ to 15 g/m$^2$ of a burn adjusting agent and 1 g/m$^2$ to 30 g/m$^2$ of a calcium phosphate-based compound.

The burn adjusting agent preferably includes an organic acid salt.

It is preferable in the present invention that the calcium phosphate-based compound be tricalcium phosphate and the burn adjusting agent comprises a citrate salt.

Further, in the present invention, it is preferable that the basis weight of the wrapper paper be 40 g/m$^2$ or more and 70 g/m$^2$ or less.

DETAILED DESCRIPTION OF THE INVENTION

The present invention will now be described in more detail.

The wrapper paper for a smoking article according to the present invention can be manufactured by beating pulp fibers, which are conventionally used in the manufacture of wrapper paper, and adding thereto calcium phosphate-based compound to provide a predetermined content, thus preparing a paper stuff. The paper stuff is machine-processed and a burn adjusting agent is applied to the paper stuff being processed to have a predetermined content. A preferable example of the pulp fiber is flax pulp. The basis weight of the wrapper paper is not particularly limited, but is usually 20 g/m$^2$ or more and 80 g/m$^2$ or less, preferably 40 g/m$^2$ or more and 70 g/m$^2$ or less.

The burn adjusting agent used in the present invention may be of any ordinary type that is used in ordinary wrapper paper as being capable of effecting on the static burn rate of the wrapper paper. As the burn adjusting agent, organic acid salts such as potassium acetate, a succinate salt, a tartrate salt and an acetate salt are well known in the art, in addition to sodium acetate, and these agents can be used in the present invention. Of these, sodium acetate is particularly preferable. In the present invention, the burn adjusting agent is carried in the wrapper paper in an amount of 1 g/m$^2$ to 15 g/m$^2$. When the content of the burn adjusting agent is less than 1 g/m$^2$, a sufficient sidestream smoke reducing effect cannot be obtained, whereas when it exceeds 15 g/m$^2$, the stability in the production of the wrapper paper may be lost. A preferable amount of the burn adjusting agent is 1 g/m$^2$ to 10 g/m$^2$, and more preferably 2 g/m$^2$ to 5 g/m$^2$ when the taste of the tobacco is taken into consideration.

The wrapper paper of the present invention carries a calcium phosphate-based compound, in addition to the burn adjusting agent in the above-described amount. As the calcium phosphate-based compound, a calcium phosphate-based compound having a Ca/P molar ratio of 1.0 to 2.0, preferably, tricalcium phosphate, hydroxyapatite or amorphous calcium phophate can be used. As the calcium phosphate-based compound, tricalcium phosphate, which is a food additive and commercially available at a low price, is particularly preferable. In the present invention, the calcium phosphate-based compound is carried in the wrapper paper in an amount of 1 g/m$^2$ to 30 g/m$^2$. When the content of the calcium phosphate-based compound is less than 1 g/m$^2$, a sufficient sidestream smoke reducing effect cannot be obtained even if it is combined with the predetermined amount of the burn adjusting agent, whereas when the content exceeds 30 g/m$^2$, the strength of the wrapper paper deteriorates, which makes it difficult to produce cigarettes with high-speed cigarette making machine of the current type.

The wrapper paper of a smoking article according to the present invention may contain, in addition to the above-described burn adjusting agent and calcium phosphate-based compound, a filler material such as calcium carbonate, which is ordinarily used in wrapper papers. It is preferable in aspect of increasing the non-transparency of the wrapper paper that calcium carbonate is carried in the paper in amount of about 10 g/m$^2$, when manufacturing the wrapper paper for a smoking article according to the present invention.

The present invention will now be described by way of Examples; however the present invention is not limited to these Examples.

EXAMPLES

To flax pulp that was beaten to 80° SR of a Schopper freeness of 1 g method (Schopper freeness in conformance with JIS P 8121 except that the concentration of the slurry pulp was set to 0.1%), spindle-shaped calcium carbonate (PCX-850: average granularity of 3.5 $\mu$m, a product of Shiraishi Kogyo Co. Ltd.) and tricalcium phosphate of Wako Junnyaku Kogyo Co. Ltd. (a chemical reagent grade, model number: 032-10855) were added as an internal fillers to have predetermined contents in the paper, thus preparing paper stuff. Then, the paper stuff was processed with use of TAPPI standard-type manual paper machine into wrapper paper. The spindle-shaped calcium carbonate and tricalcium phosphate were added to the contents indicated in TABLE 1. With regard to the wrapper paper on which the burn adjusting agent, an aqueous solution of sodium acetate was applied so as to make a predetermined amount, and then dried, thus manufacturing the paper.

It should be noted that tricalcium phosphate of Wako Junnyaku Kogyo Co. Ltd. used was powdery tricalcium phosphate, the label of which indicated "This product generally has a composition of hydroxyapatite, $[Ca_3(PO_4)_2]_3.Ca(OH)_2$."

Using the wrapper paper prepared, cigarettes were prepared. The size of the cigarettes was a generally called FK size, which had a circumference of 24.9 mm, a length of tobacco column of 59 mm, a length of filter of 25 mm and a length of tip paper of 32 mm. The cut tobacco used was of an American blend type which is used in ordinary commercial products, and its filling amount was 0.580 g/cigarette. These cigarettes were conditioned at 22° C. and a relative humidity of 60%, and then selected by a weight per cigarette of 0.885±0.01 g. Thus selected cigarettes were subjected to the test. The contents of the fillers (tricalcium phosphate and calcium carbonate), the content of the burn adjusting agent (sodium citrate), the basis weight, and the amount of sidestream smoke when the cigarette was subjected to static burn for a length of 4.9 mm by means of the fishtail method, for each case, were summarized in TABLE 1.

With regard to the wrapper paper A to F, the amount of sidestream smoke was measured for each of cigarettes that were made of wrapper papers having various amounts of calcium carbonate and sodium citrate added thereto.

With regard to the wrapper paper G to I, the burn adjusting agent was not added, and the amount of sidestream smoke was measured for each of cigarettes that were made of wrapper papers having various amounts of fillers, calcium carbonate and tricalcium phosphate, added thereto.

With regard to the wrapper paper J to P, calcium carbonate (10 g/m$^2$), which is used in ordinary tobacco wrapper papers, was added, and the amount of sidestream smoke was measured for each of cigarettes that were made of wrapper papers having various amounts of tricalcium phosphate and sodium citrate added thereto.

As can be seen from the results presented in TABLE 1, the cigarettes that used the wrapper papers L to P, which were the products according to the present invention, achieved such low sidestream smoke amounts that could not achieved with those cigarettes made with use of wrapper papers prepared with a combination of the conventional fillers and burn adjusting agent.

TABLE 1

| Wrapper paper | Tricalcium phosphate as a filler (g/m$^2$) | Calcium carbonate as a filler (g/m$^2$) | Total of fillers (g/m$^2$) | Sodium citrate as a burn adjusting agent (g/m$^2$) | Basis weight (g/m$^2$) | Sidestream smoke amount (mg/49 mm) |
|---|---|---|---|---|---|---|
| A (Comp. Ex.) | 0.0 | 10.0 | 10.0 | 0.0 | 40.0 | 23.1 |
| B (Comp. Ex.) | 0.0 | 10.0 | 10.0 | 0.7 | 40.7 | 17.2 |
| C (Comp. Ex.) | 0.0 | 10.0 | 10.0 | 4.4 | 44.4 | 16.1 |
| D (Comp. Ex.) | 0.0 | 10.0 | 10.0 | 9.6 | 49.6 | 16.1 |
| E (Comp. Ex.) | 0.0 | 15.0 | 15.0 | 4.5 | 44.5 | 15.9 |
| F (Comp. Ex.) | 0.0 | 15.0 | 15.0 | 9.6 | 49.6 | 16.0 |
| G (Comp. Ex.) | 0.5 | 10.0 | 10.5 | 0.0 | 40.5 | 22.9 |
| H (Comp. Ex.) | 5.0 | 10.0 | 15.0 | 0.0 | 45.0 | 22.6 |
| I (Comp. Ex.) | 10.0 | 10.0 | 20.0 | 0.0 | 50.0 | 21.8 |
| J (Comp. Ex.) | 5.0 | 10.0 | 15.0 | 0.6 | 45.6 | 17.0 |
| K (Comp. Ex.) | 0.5 | 10.0 | 10.5 | 4.5 | 45.0 | 16.0 |
| L (The invention) | 2.5 | 10.0 | 12.5 | 2.0 | 44.5 | 15.5 |
| M (The invention) | 2.5 | 10.0 | 12.5 | 4.6 | 47.1 | 15.2 |
| N (The invention) | 5.0 | 10.0 | 15.0 | 10.4 | 55.4 | 14.0 |
| O (The invention) | 7.5 | 10.0 | 17.5 | 5.1 | 52.6 | 15.0 |
| P (The invention) | 10.0 | 10.0 | 20.0 | 10.0 | 60.0 | 14.0 |

As described above, according to the present invention, there can be provided wrapper paper for a smoking article, with which the tobacco sidestream smoke can be reduced further effectively than the conventional wrapper papers.

What is claimed is:

1. Wrapper paper for a smoking article, said wrapper paper carrying 1 $g/m^2$ to 15 $g/m^2$ of a burn adjusting agent, and 1 $g/m^2$ to 30 $g/m^2$ of a calcium phosphate-based compound in the wrapper paper;

wherein the calcium phosphate-based compound is tricalcium phosphate and the burn adjusting agent comprises a citrate salt.

2. The wrapper paper according to claim 1, wherein the burn adjusting agent is carried in amount of 1 $g/m^2$ to 10 $g/m^2$.

3. The wrapper paper according to claim 1, wherein the burn adjusting agent comprises an organic acid salt.

4. The wrapper paper according to claim 1, wherein a basis weight of the wrapper paper is 40 $g/m^2$ or more and 70 $g/m^2$ or less.

* * * * *